United States Patent [19]

Bellis

[11] 4,297,980

[45] Nov. 3, 1981

[54] MOTOR VEHICLE CARBURETOR CHOKE MECHANISM

[75] Inventor: Andrew G. Bellis, Plymouth Township, Wayne County, Mich.

[73] Assignee: Ford Motor Company, Dearborn, Mich.

[21] Appl. No.: 138,955

[22] Filed: Apr. 10, 1980

[51] Int. Cl.[3] ..... F02B 7/00; F02B 75/10

[52] U.S. Cl. ..... 123/438; 60/304; 60/307; 261/39 B; 261/39 E; 261/39R

[58] Field of Search ..... 60/304, 305, 307; 123/435, 438; 261/39 B, 39 E, 39 R

[56] References Cited

U.S. PATENT DOCUMENTS

| | | | |
|---|---|---|---|
| 3,791,144 | 2/1974 | Lang | 60/304 |
| 3,877,223 | 4/1975 | Layton | 60/307 |
| 3,965,224 | 6/1976 | Freismuth | 261/39 B |
| 4,038,819 | 8/1977 | Yoshikawa et al. | 60/307 |

*Primary Examiner*—Wendell E. Burns
*Attorney, Agent, or Firm*—Robert E. McCollum; Clifford L. Sadler

[57] ABSTRACT

An automotive type carburetor is provided with a choke construction that assures opening of the choke valve without the use of vacuum in the event of an electrical failure in the choke assembly, or a failure in the secondary air pump system of the engine; the choke housing being supplied with hot air under pressure from the engine secondary air pump to warm the choke bimetal, the choke assembly also including a PTC heater element to independently warm the bimetal, either heating means being adequate to assure opening of the choke valve within a desired time in the event of a failure of the other heating means.

5 Claims, 3 Drawing Figures

10
12
14
16
18
20
22
24
28
30
36
38
40
42
44
46
48
52
54
56
58
60
68
72
74
76
78
80
82
84
86
88
90
92
94
96
98

98
68
72
74
62
64
60
104
100
102
110
108
106
112
68
108
112
98
76
80
78
82
70

MOTOR VEHICLE CARBURETOR CHOKE MECHANISM

This invention relates in general to an automatic choke mechanism for an automotive type carburetor. More particularly, it relates to a choke mechanism that assures an opening of the choke valve within a short period after initial starting of the motor vehicle.

Most passenger car type motor vehicles have in the past used an automatic choke mechanism for cold engine starting operations. For many years, this consisted of a coiled bimetal spring connected to the choke valve for urging it closed with a force that increased with decreases in the ambient temperature level. The chamber in which the bimetal was located generally was warmed by drawing hot air through the chamber from a hot air stove such as, for example, an exhaust manifold heated plenum, connected to vacuum by a line to the carburetor induction passage below the throttle valve. As a result, during engine warmup, the choke bi-metal would slowly decrease its choke closing force and permit the unbalance mounted choke valve to open by the flow of air against it. U.S. Pat. No. 3,965,224, Freismuth, assigned to the assignee of this invention, is a typical illustration of this type of choke construction.

In subsequent years, with the increased use of emission control devices, the level of vacuum available decreased. Altitude conditions also affected vacuum availability. Also playing a factor was the increased use of aluminum manifolds, for example, which did not radiate or retain the heat as readily as cast iron types. As a result of the latter, for example, during the initial engine warmup period, the level of hot air sometimes was too low to warm the bimetal spring so that the choke valve would not fully open within a reasonable time.

This then led to the use of the electric choke; that, is, the use of, for example, a PTC (positive temperature coefficient) semiconductor heater that was self-limiting in output temperature level. When current was applied to the heater, heat was transferred immediately to the bimetal spring to slowly warm it to the temperature level that would cause opening of the choke valve. Upon reaching a certain internal temperature level, the heat output tapered off so that an additional cutout switch was unnecessary. U.S. Pat. No. 4,050,024, Nelson, assigned to the assignee of this invention, is an illustration of this type of choke construction, and utilizes an electric PTC heater as well as vacuum induced hot air flow through the choke housing.

Subsequently, therefore, many passenger car type motor vehicles were equipped with an automatic choke that included an electric PTC heater or the equivalent, and in some cases an electric heater as the sole heating means. This proved to be beneficial from another standpoint. As stated previously, the vacuum for drawing hot air through the choke housing was obtained from the carburetor induction passage at a point below the throttle valve. This causes an additional volume of air that must be compensated for in setting the idle speed, and one that frequently results in a higher idle speed than may be desired. The use of the electric choke type construction eliminated this disadvantage because it eliminated the need for a flow of unmetered air from the choke housing into the carburetor. Therefore, the air/fuel ratio of the mixture entering or leaving the carburetor now could be accurately calibrated.

The advent of the all-electric choke construction, however, posed a different problem. In the event of a failure of the electrical system for the choke per se, there would be no heat available during engine warm up to be transferred to the bimetal spring to permit the choke valve to open. Accordingly, the choke valve would remain closed for a longer period of time than would be desired, resulting in a richer air/fuel mixture flowing to the engine for a longer period. Eventually, the choke valve would open due to the prevailing ambient temperature in the engine compartment. As stated previously, to incorporate a vacuum type hot air system for the choke assembly generally was not satisfactory because of the low levels of heat and vacuum available in some engine installations.

This invention minimizes the above problems by providing a choke construction having not only an electrical heater but also a positive pressure source of hot air so that if one or the other of the heat sources should fail, the remaining heat source will still effect an opening of the choke valve in a desired manner. The positive pressure source in this case is from the engine secondary air pump already present on most engines.

Positive pressure hot air systems are known. U.S. Pat. No. 3,877,223, Layton, for example, shows a two-stage automatic choke construction that utilizes the vacuum system of the carburetor in combination with the engine secondary air pump system to provide flow of hot air through the choke housing. However, it will be noted in this case that the dual stage operation is initiated by first drawing the engine secondary air through the choke housing when the engine is in idling condition at a higher manifold vacuum level, followed by a pushing of the same air through the housing by the air pump when the vacuum level decreases at wide open throttle conditions. This type of construction requires that the vacuum system operate well enough to draw sufficient air through the choke housing. It fails to provide a way of heating the choke bimetal in the event of failure of the air pump, for example, and/or a low vacuum level.

It is, therefore, a primary object of this invention to provide an automatic choke mechanism for a motor vehicle type engine carburetor that will provide the necessary heat to the choke bimetal to slowly open the choke valve without dependence upon any vacuum force to pull hot air through the choke housing and even though an electrical failure may occur in the choke mechanism.

It is another object of the invention to provide a choke mechanism of the type described including, (1) an electric heater mechanism in the choke housing for transferring heat to the choke bimetal and, (2) an independently operable pressurized hot air flow through the choke housing in a parallel type operation to independently warm the bimetal means, the two systems assuring a normal operation of the choke valve in the event of failure of one or the other of the systems.

It is a further object of the invention to provide a choke mechanism of the type described in which hot air is forced under pressure through the choke housing, the pressure varying as a function of the engine speed to render the hot air flow independent of the vacuum system of the carburetor.

It is another object of the invention to provide a vacuumless choke mechanism of the type described in which the hot air flow is supplied from the engine air pump used to provide secondary air to the exhaust ports of the engine cylinders for emission control purposes so long as the engine is operating.

Other objects, features, and advantages of the invention will become more apparent upon reference to the succeeding, detailed description thereof, and to the drawings illustrating the preferred embodiment thereof, wherein.

Figure 1:
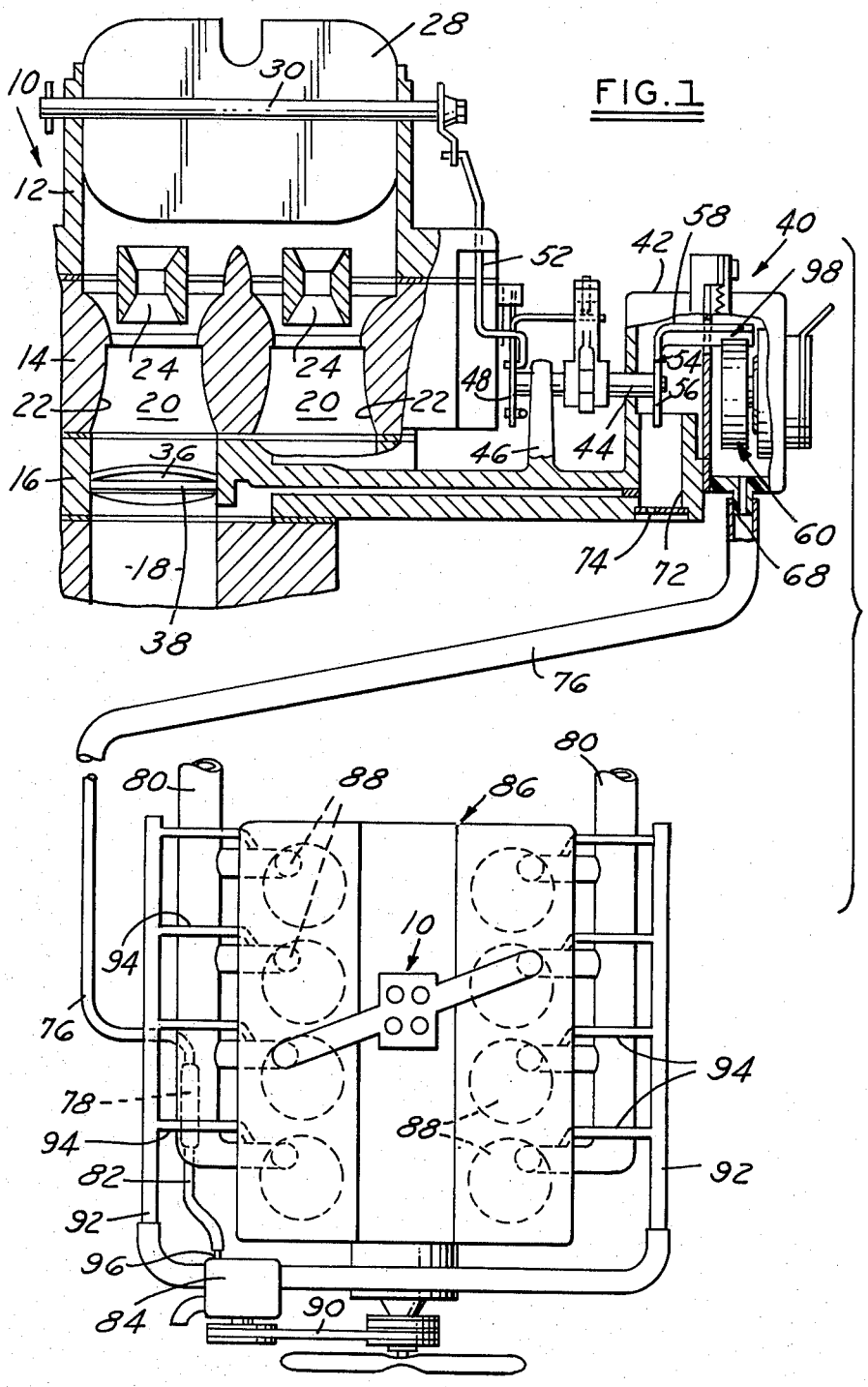
FIG. 1 is a cross-sectional view of a portion of an internal combustion engine and an associated carburetor.
Figures 2, 3:
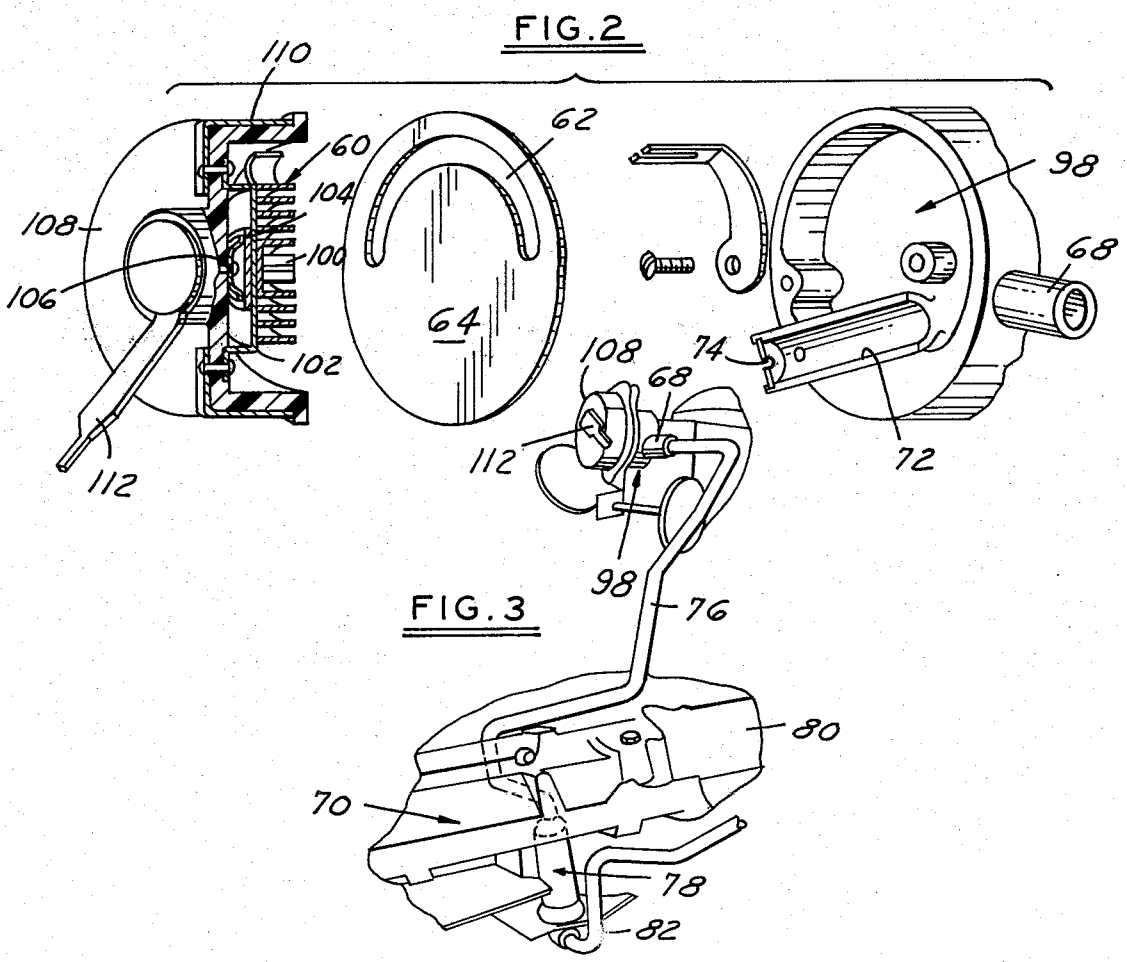
FIG. 2 is an exploded, enlarged view of a detail of FIG. 1.

FIG. 3 schematically illustrates a detail associated with the engine shown in FIG. 1.

The carburetor 10 of FIG. 1 is obtained by passing a plane through approximately one-half of a known type of four-barrel, down-draft type carburetor. The portion of the carburetor shown includes an upper air horn section 12, an intermediate main body portion 14, and a throttle valve flange section 16. The three carburetor sections are secured together by suitable means, not shown, over an intake manifold indicated partially at 18 leading to the engine combustion chambers.

Main body portion 14 contains the usual air-fuel mixture induction passages 20 having fresh air intakes at the air horn ends, and connected to manifold 18 at the opposite ends. The passages are each formed with a main venturi section 22 containing a booster venturi 24 suitably mounted for cooperation therewith, by means not shown.

Air flow through passages 20 is controlled in part by a choke valve 28 unbalance mounted on a shaft 30 rotatably mounted on side portions of the carburetor air horn, as shown. Flow of fuel and air through each passage 20 is controlled by a conventional throttle valve 36 (only one shown) fixed to a shaft 38 rotatably mounted in flange portion 16. The throttle valves are rotated in a known manner by depression of the vehicle accelerator pedal, and move from the idle speed position shown essentially blocking flow through passage 20 to a wide open position essentially at right angles to the position shown.

The rotative position of choke valve 28 is controlled by a semiautomatically operating choke mechanism 40. The latter includes a hollow housing portion 42 that is formed as an extension of the carburetor throttle flange. The housing is apertured for rotatably supporting one end of a choke lever operating shaft 44, the opposite end being rotatably supported in a casting 46. A bracket or lever portion 48 is fixed on the left end portion of shaft 44 for mounting the end of a rod 52 that is pivoted to choke valve shaft 30. It will be clear that rotation of shaft 44 in either direction will correspondingly rotate choke valve 28 to open or close the carburetor air intake, as the case may be.

An essentially L-shaped thermostatic spring lever 54 has one leg 56 fixedly secured to the opposite or right-hand end portion of shaft 44. The other leg portion 58 of the lever is secured to the outer end of a coiled bimetallic thermostatic spring element 60 through an arcuate slot 62 (FIG. 2) in an insulating gasket 64.

The housing 42 is provided with a hot air passage 68 connected to an exhaust manifold heat stove 70 (FIG. 3), in a manner to be described. The housing also has a cylindrical bore 76 connected to the chamber with a controlled area air vent opening 74. Hot air thus can be forced into the area from passage 68 and around the spring coil 60 through hole 62 in gasket 64 and out through hole 74.

The hot air entering passage 68 is supplied by the hot air stove 70, as mentioned. As seen in FIG. 3, the passage 68 is connected by an insulated tube 76 to the outlet end of a passage 78 formed as a part of the engine exhaust manifold 80. The opposite inlet end of passage 78 is connected to a supply tube 82. Air flowing through passage 78, therefore, is warmed by the heat of the exhaust manifold.

The supply tube 82 is in turn connected to the outlet of the engine secondary air pump 84, as best seen in FIG. 1. More particularly, FIG. 1 shows schematically a plan view of a portion of a conventional V-8 internal combustion engine 86 having right and left banks of cylinders each with exhaust ports 88. Also shown is an air injection system consisting of air pump 84 driven by the engine through a belt 90 to deliver air to each exhaust port through manifolding 92 and injectors 94. The air combines with the unburned hydrocarbons and carbon monoxide that pass into the exhaust system and reduces them to $H_2O$ and $CO_2$. The air pump has a third outlet 96 that is connected to supply tube 82.

As thus far described, it will be clear that the choke thermostatic spring element 60 will contract or expand as a function of the changes in temperature conditions of the air forced into passage 68; or, if there is not flow, such as when the engine is off, the temperature or the air within chamber 98. Accordingly, changes in temperature will rotate the spring lever 54 to rotate shaft 44 and choke valve 28 in one or the other directions as the case may be.

Referring to FIG. 2, it will be seen that the thermostatic coiled spring 60 is centrally staked to a metal post 100. The post is formed as an integral part of a thin metal disc 102 that is approximately the diameter of coil 60. The disc constitutes a heat sink or transfer member to evenly radiate heat to the coil from a PTC heater element or pill 104 to which it is secured.

Heater element 104 is of a known type. See Nelson U.S. Pat. No. 4,050,024, previously referred to. It is a ositive temperature coefficient (PTC) semiconductor in the shape of a flat ceramic disc that is fixed on disc 102. It has a central spring-leg type current carrying contact lug 106 that projects through an insulated cover or choke cap 108. The heat sink disc is grounded through the cover to the cast housing by extension and ground terminals 110. Lug 106 conducts current to the heater from a terminal 112 connected to a wire harness. The vehicle alternator could serve as a suitable source of electrical energy to the harness, when the vehicle is running.

A characteristic of the PTC heater is that its internal resistance varies directly with the skin temperature of the element, from a predetermined switch point. When the PTC heater 104 is electrically energized, the Joule heat causes rapid self-heating of the PTC element. The heater resistance remains almost constant as it heats from room temperature. It increases as the PTC temperature nears the switching temperature or desired upper limit, at which point the resistance increases sharply. From there on, the heat output is essentially constant.

It will be seen, therefore, that it is an inherent property of this semiconductor to obtain a very high impedance to current flow at high internal temperatures, and that the semiconductor has an ability to maintain a high maximum temperature. The need for a cut off thermostat to protect against distortion of the bi-metallic coil 60, therefore, due to extreme temperature levels, is thereby eliminated.

In this instance, therefore, the PTC device provides heat to coil 60 that is independent of that provided by the pressurized exhaust manifold hot air system. When the engine is started, current passes through the PTC element, and a change in the internal temperature is noticed. This heat generated is transferred by conduction to coil 60 through the post 100 and by radiation to the coil from the heat sink 102.

When the PTC internal temperature reaches the switching temperature, the internal resistance is so high that the current flow is very low and essentially cut off. The heat input to the PTC element by the current flow then is essentially balanced by the heat loss by the PTC to the environment and to the bi-metal post 100. Therefore, for all intents and purposes, the heat of the PTC remains at a constant level.

The operation of the invention is believed to be clear from the above description and from a consideration of the drawings. In brief, once the engine has been started, the secondary air pump 84 will immediately begin supplying air under pressure to the supply tube 82 for passage through the exhaust manifold where the air is warmed by the hot exhaust gases. It then passes into the choke housing and immediately begins to slowly warm the choke bimetal 60 in proportion to the heat of the exhaust manifold.

Simultaneously, upon startup of the engine, electrical current supplied to the PTC heater element 104 will also immediately apply heat to the choke bimetal 60 to slowly warm it. The heat from both the secondary air system and the PTC element will cause a slow unwinding of the coil spring 60 and a decrease in the closing force acting on the choke valve 28. Accordingly, air flow through the carburetor will slowly cause the unbalanced mounted choke valve to open until its fully open position is obtained.

From the above, it will be seen that the invention provides two systems of heating the choke bimetal to assure an opening of the choke valve. If for some reason the air pump 84 should fail, the electric choke PTC heter system would be sufficient to cause an opeing of the choke valve. On the other hand, should an electrical failure occur in the choke system per se, so that no current is supplied to the PTC heater 104, heat could still be supplied to the secondary air pump system through the passage 68 supplying air warmed by passage through the exhaust manifold in the manner previously described.

While the invention has been shown and described in its preferred embodiment, it will be clearer to those skilled in the arts to which it pertains that many changes and modifications may be made thereto without departing from the scope of the invention.

I claim:

1. A dual-stage vacuumless automatic choke mechanism for use with an engine mounted carburetor having an air/fuel induction passage and an unbalance mounted choke valve rotatably mounted for a variable movement across the passage between an open and closed position to control flow through the passage, the choke mechanism including a housing having an air inlet and outlet, a thermostatic spring means mounted in the housing and operably connected to the choke valve urging the choke valve towards a closed position with a force increasing as a function of decreases in the temperature of the spring means from a predetermined level, the one stage including an engine driven air pump providing a source of air, under pressure that varies with changes in engine speed, conduit mens connecting the air under pressure from the pump to the choke housing inlet, and engine stove means associated with the conduit means for heating the air under pressure prior to entry into the housing whereby the heat is transferred to the spring means for warming the same to reduce its choke valve closing force and permit opening of the choke valve by air flow thereagainst, the other stage comprising electrical heater mens in the housing operably associated with the spring means for transferring its heat output to the spring means independently of the one stage means to warm the spring means and reduce the choke valve closing force of the spring means, each stage being operably independently of the operability of the other stage to assure a slow movement of the choke valve to its open position without the use of vacuum from the carburetor induction passage.

2. A choke mechanism as in claim 1, the housing outlet having a flow restrictor therein to control the flow of air under pressure through the housing.

3. A choke mechanism as in claim 1, the electrical heater means comprising a self-limiting output temperature positive temperature coefficient (PTC) element.

4. A choke mechanism as in claim 1, the electrical heater means being continuously operable to provide a continuous supply of heat to the spring means.

5. A choke mechanism as in claim 1, the stove means comprising a housing adjacent the exhaust manifold of the engine, a first tube connecting the output of the air pump to the stove housing, a second tube connecting the stove housing to the choke housing inlet.

* * * * *